US009245431B2

(12) United States Patent
Williamson et al.

(10) Patent No.: US 9,245,431 B2
(45) Date of Patent: Jan. 26, 2016

(54) COVER MOUNTED CIRCUIT BOARD AND ANTENNA

(71) Applicant: Cinch Systems, Inc., St. Michael, MN (US)

(72) Inventors: William Williamson, St. Michael, MN (US); Joel Curtis Christianson, Corcoran, MN (US)

(73) Assignee: Cinch Systems, Inc., St. Michael, MN (US)

( * ) Notice: Subject to any disclaimer, the term of this patent is extended or adjusted under 35 U.S.C. 154(b) by 182 days.

(21) Appl. No.: 13/951,512

(22) Filed: Jul. 26, 2013

(65) Prior Publication Data

US 2015/0029023 A1 Jan. 29, 2015

(51) Int. Cl.

| | |
|---|---|
| ***G08B 1/08*** | (2006.01) |
| ***G08B 13/08*** | (2006.01) |
| ***G08B 13/24*** | (2006.01) |
| ***G08B 13/04*** | (2006.01) |

(52) U.S. Cl.

CPC ..... *G08B 13/08* (2013.01); *G08B 13/04* (2013.01); *G08B 13/2491* (2013.01)

(58) Field of Classification Search

CPC ..... G08B 13/08; G08B 1/04; G08B 13/2491; G08B 13/122; G08B 13/126; G08B 21/18; F25D 29/008; F25D 2700/02

USPC ..... 340/547, 545.2, 545.1, 545.4, 545.5, 340/545.7, 540, 541, 539.1; 70/208; 29/600

See application file for complete search history.

(56) References Cited

U.S. PATENT DOCUMENTS

| | | | | |
|---|---|---|---|---|
| 6,952,165 | B2 * | 10/2005 | Kovach et al. | 340/545.1 |
| 7,151,461 | B2 * | 12/2006 | Wilson et al. | 340/644 |
| 7,321,282 | B2 * | 1/2008 | Lee et al. | 335/205 |
| 2005/0024207 | A1 * | 2/2005 | Schebel et al. | 340/545.2 |

* cited by examiner

*Primary Examiner* — Anh V La

(74) *Attorney, Agent, or Firm* — Schwegman Lundberg & Woessner, P.A.

(57) ABSTRACT

A security sensor includes a wall mount having features for fixing the wall mount to a wall to monitor an area for security. A cover is adapted to attach to the wall mount. The cover includes a base to couple to the wall mount, connectors to couple to a power source, a circuit board supported proximate the base and coupled to the connectors, the circuit board having a transmitter to receive signals from a sensor and wirelessly transmit the signals, and an antenna coupled to the circuit board and spaced from the wall to reduce electromagnetic interference from the wall.

20 Claims, 4 Drawing Sheets

COVER MOUNTED CIRCUIT BOARD AND ANTENNA

BACKGROUND

Many security sensors mount to a wall near a door or window to sense whether the door or window is opened, and to send a wirelessly transmitted signal to a central controller. Such sensors are battery operated, and may contain a circuit board and an antenna, along with a magnetic switch. When such sensors are mounted near metal, such as is used in many forms of commercial construction, performance and range of the wireless transmission can be impeded by the metal near the sensor. To alleviate degraded performance of the wireless transmissions, power levels have been increased, and antennas lengthened. In some cases, a rabbit tail antenna has been used, extending outside a sensor enclosure, which is not aesthetically pleasing and is also subject to efforts to tamper with the sensors.

SUMMARY

A security sensor includes a wall mount having features for fixing the wall mount to a wall to monitor an area for security. A cover is adapted to attach to the wall mount. The cover includes a base to couple to the wall mount, connectors to couple to a power source, a circuit board supported proximate the base and coupled to the connectors, the circuit board having a transmitter to receive signals from a sensor and wirelessly transmit the signals, and an antenna coupled to the circuit board and spaced from the wall to reduce electromagnetic interference from the wall.

In one embodiment, a method includes installing a wall mount on a metal containing structure and coupling a cover to the wall mount, wherein the cover contains a circuit board receiving security sensor signals and transmitting information via an antenna coupled to the circuit board, the circuit board being positioned such that the antenna is spaced from the structure to reduce electromagnetic interference from the metal in the structure.

DETAILED DESCRIPTION

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, logical and electrical changes may be made without departing from the scope of the present invention. The following description of example embodiments is, therefore, not to be taken in a limited sense, and the scope of the present invention is defined by the appended claims.

Figure 1:
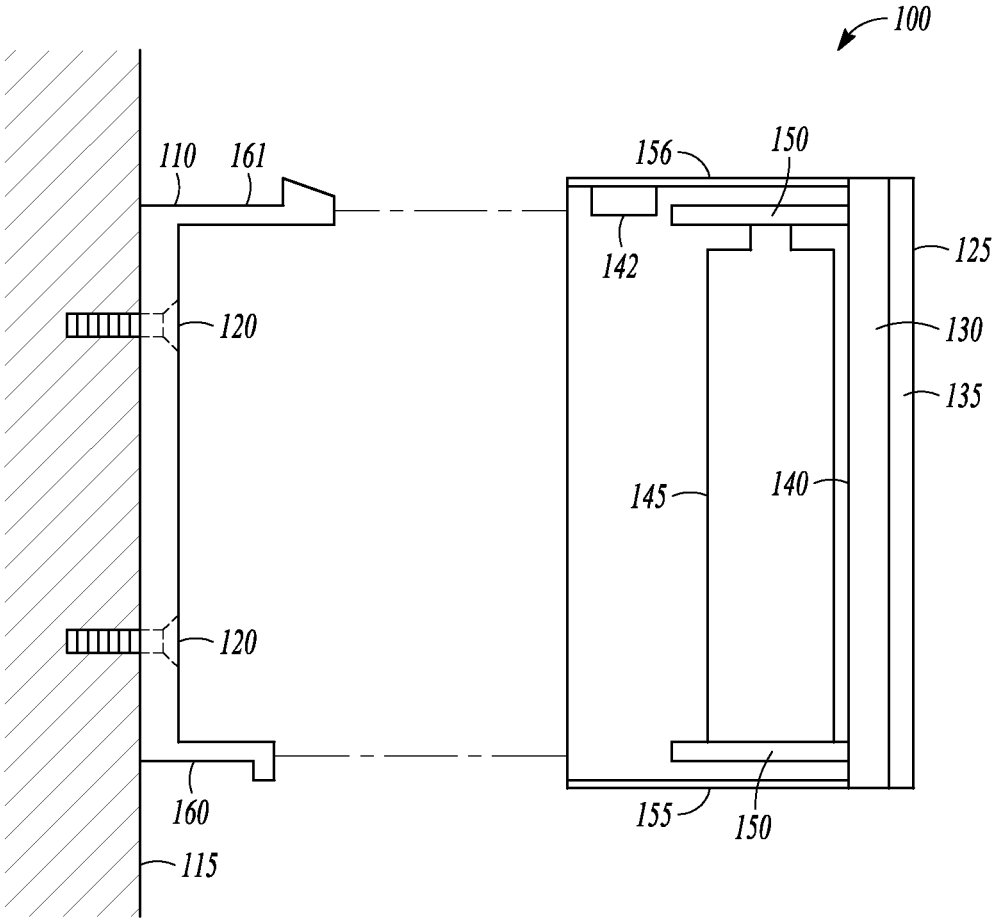
FIG. 1 is a cross sectional side view of a security sensor according to an example embodiment.

FIG. 1 is a cross sectional side view of a security sensor 100 according to an example embodiment. The side view provides a simplified view of security sensor 100 in order to more clearly illustrate selected parts. A wall mount 110 is shown affixed to a structure 115. The structure 115 may be a wall, door frame, window frame, or other structure in an area to be monitored for security. The structure may contain metal, which may result in electromagnetic inference when the security sensor transmits information using an antenna that is not sufficiently spaced from the structure.

A cover 125 is show separated from the wall mount 110, and contains a circuit board 130 having an antenna 135 positioned on a surface of the circuit board opposite the structure 115 when the cover 125 is coupled to the wall mount 110. By placing the circuit board 130 with antenna 135 in the cover spaced from the structure 115, interference with transmissions from the structure is reduced. In various embodiments, the wall mount 110 and cover 125 may be formed of plastic via injection molding. Other materials and processes of making them may be used in further embodiments.

In one embodiment, a side 140 of circuit board 130 closest to the structure contains typical sensor related circuitry, such as a wireless transceiver and processing circuitry to receive signals from a sensor 142, such as a magnetic switch located on the security sensor 100 near a magnet mounted on a moveable part near the structure, such as window or a door. When the window or door moves, the magnet moves away from the sensor 142, causing the conductivity of the switch to change, resulting in a sensor signal that a door or window has been opened.

In further embodiments, sensor 142 may be a motion sensor, proximity detector, glass breakage sensor, or any other type of security related sensor. Such sensors provide a signal to circuitry on circuit board 130, which then transmits information via antenna 35 such that it is received by a controller. In one embodiment, the antenna 135 may be formed of metamaterials to increase the efficiency of the antenna 135 and further conserve power of a battery 145 that is coupled to connectors 150.

Cover 125 contains sidewalls 155, 166 that mate with corresponding legs 160, 161 on wall mount 120. The sidewalls may contain opening that fit with protrusions on the legs to provide a snap fit retention mechanism. In further embodiments, many other different configurations of mating parts to retentively couple the wall mount and cover may be used, including but not limited to screws, clamps, and other fasteners.

Figure 2:
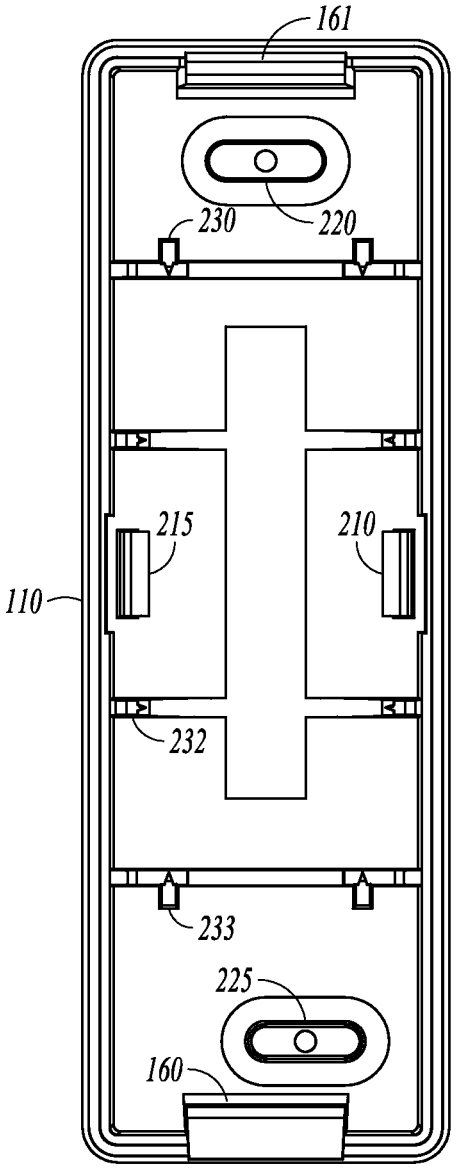
FIG. 2 is a top view of a wall mount of a security sensor according to an example embodiment.

FIG. 2 is a top view of the wall mount 110 of a security sensor according to an example embodiment. Reference numbers are reused for like parts between figures. In addition to legs 160 and 162 as primary retention constructs on ends of the wall mount 110, further legs 210 and 215 to provide guidance for the cover 110. Openings 220 and 225 are illustrated for use in fastening the wall mount 110 to a structure. Also, illustrated are multiple further legs 230, 231, 232, 233 are disposed along the length of wall mount 110. Such further legs 230, 231, 232, 233 may provide structural integrity to the wall mount, yet may be shaped to ensure the battery 145 fits when the wall mount 110 and cover 125 are coupled together.

Figure 3:
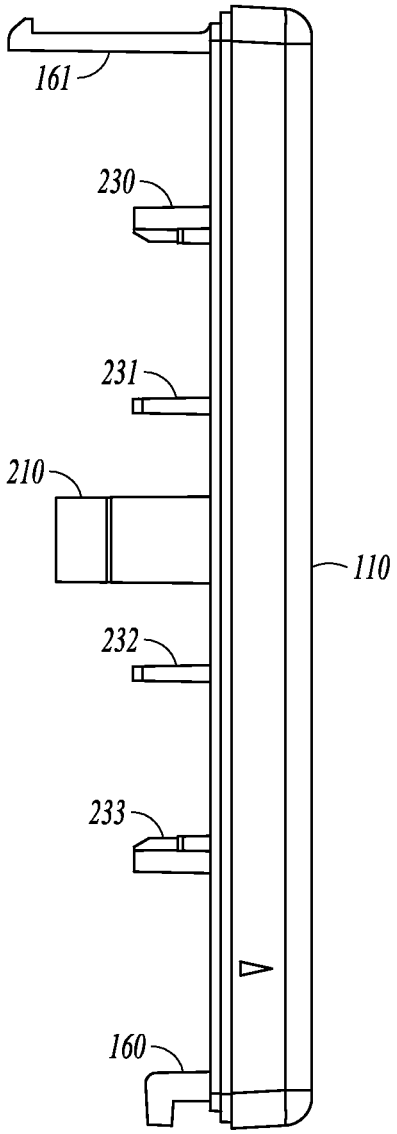
FIG. 3 is a side view of a wall mount of a security sensor according to an example embodiment.

FIG. 3 is a side view of wall mount 110 of a security sensor according to an example embodiment better illustrating the legs 160, 161, 230, 231, 232, and 233. This is just one example of a multitude of different types and positions of legs that may be used to securely align and fasten the wall mount 110 and cover 125 together.

Figure 4:
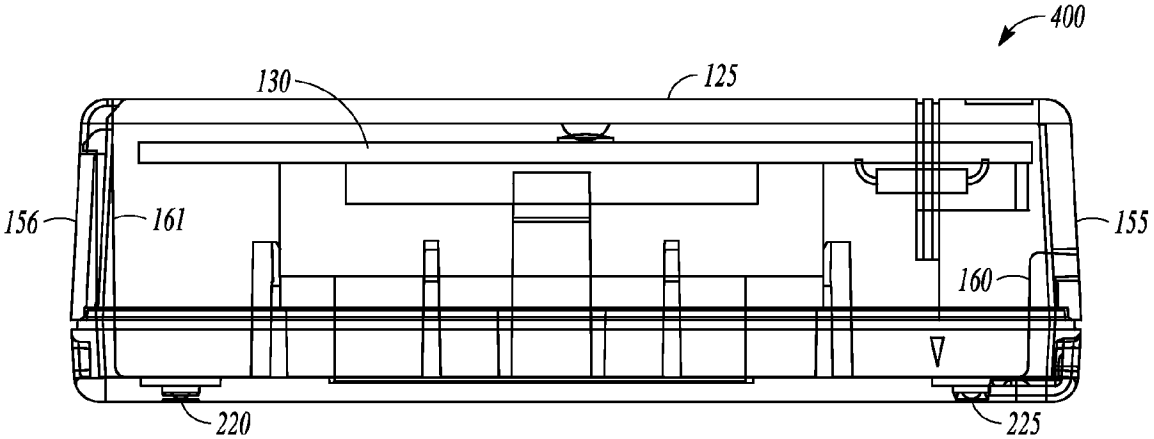
FIG. 4 is cut away side view of a security sensor illustrating internal parts according to an example embodiment.

FIG. 4 is cut away side view of an assembled security sensor 400 illustrating internal parts according to an example embodiment. FIG. 4 illustrates how the legs 160, 161 and walls 155, 156 respectively fit together. The combination of legs and walls provides a means to distance the circuit board 130 and corresponding antenna 135 from the structure 115 in order to reduce interference with transmission of information. In one embodiment, the distance is slightly larger than a diameter of a battery, such as a AAA, AA, or other types of batteries commonly used in security sensors. The distance is at least slightly larger due to additional separation from the structure 115 provided by the wall mount 110 including legs 230, 231, 232, and 233 as well as the antenna being on the other side of the circuit board from the structure 115. The distance can be increased as desired by increasing the length of the walls and/or legs connecting the cover 125 to the wall mount 110.

Figure 5:
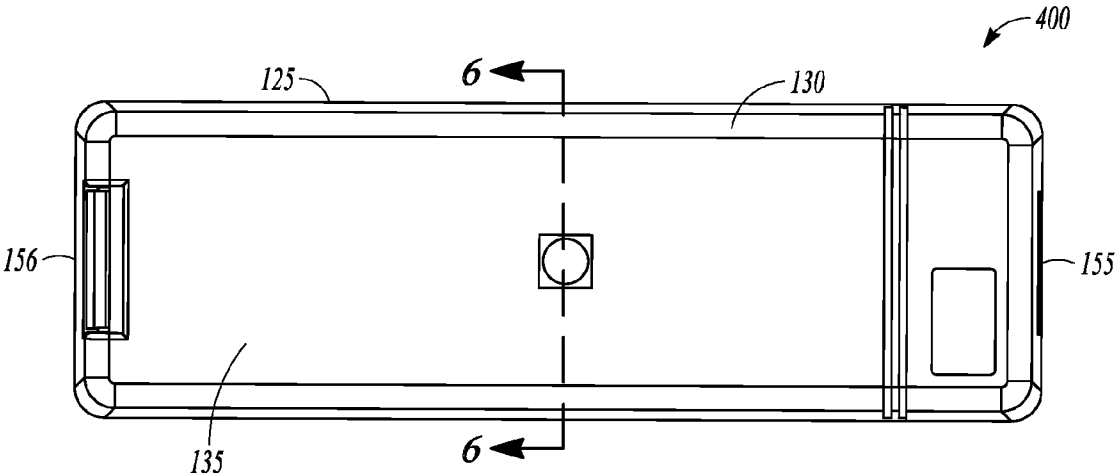
FIG. 5 is cut away top view of a security sensor illustrating internal parts according to an example embodiment.

FIG. 5 is cut away top view of a security sensor 400 illustrating internal parts according to an example embodiment. Of particular interest is the antenna 135 in this embodiment, shown having a meandering or serpentine pattern depending on materials and designs to obtain desired performance. The antenna 135 may be positioned toward one end of the circuit board away from other circuitry on the other side of the circuit board if design considerations so dictate. Antenna 135 may also extend along a longer portion with or without meandering if desired. In some embodiments, the antenna 135 may be formed on the same side of the circuit board as other circuitry, either facing away from the structure 115, or toward the structure 115 if design considerations and interference parameters permit.

Figure 6:
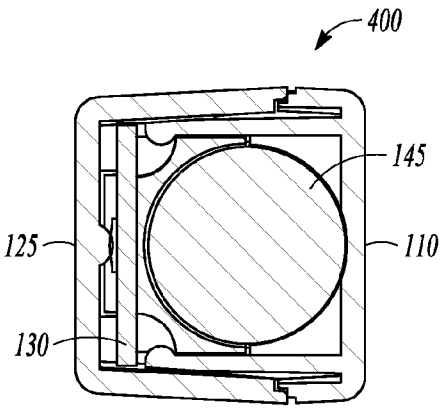
FIG. 6 is cut away end view of a security sensor illustrating internal parts according to an example embodiment.

FIG. 6 is cut away end view of a security sensor 400 illustrating internal parts according to an example embodiment. In particular, this view shows a cross section of battery 145, illustrating the separation it provides from the metal containing structure 115 two which wall mount 110 is to be fastened.

Figure 7:
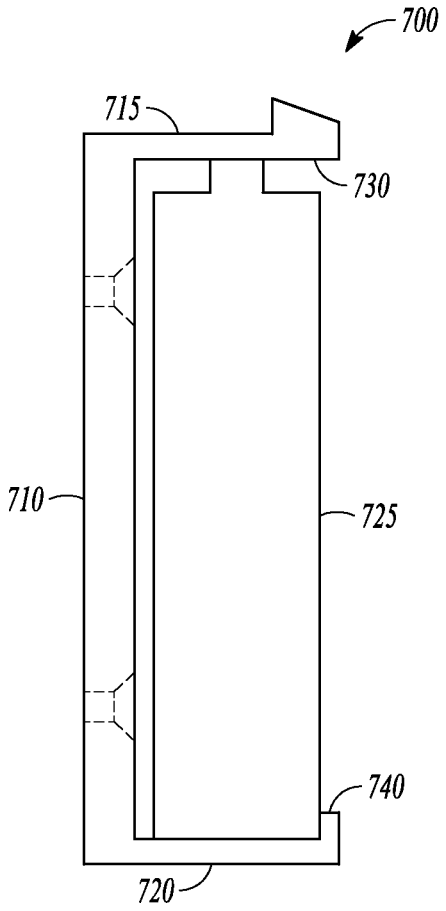
FIG. 7 is a side view of an alternative wall mount of a security sensor according to an example embodiment.

FIG. 7 is a side view of an alternative security sensor 700 wall mount 710 according to an example embodiment. Wall mount 710 includes legs 715, 720 on ends of the wall mount 710 that are spaced apart to hold a battery 725. The legs also contain protrusions to couple to a cover. Further, the legs 715, 720 contain conductors 730, 740 to carry current from the battery to mating conductors on the cover to power the circuit board. In this manner, the battery may be installed without adversely affecting the circuit board in the cover, as only conductor need mate to provide the current.

EXAMPLES

1. A security sensor comprising:
a wall mount having features for fixing the wall mount to a wall to monitor an area for security;
a cover adapted to attach to the wall mount, the cover further comprising:
a base to couple to the wall mount;
connectors to couple to a power source;
a circuit board supported proximate the base and coupled to the connectors, the circuit board having a transmitter to receive signals from a sensor and wirelessly transmit the signals; and
an antenna coupled to the circuit board and spaced from the wall to reduce electromagnetic interference from the wall.

2. The security sensor of example 1 wherein the base includes a side wall to distance the base from the wall and couple to the wall mount.

3. The security sensor of any of examples 1-2 wherein the power source comprises a battery and wherein the antenna is formed on a side of the circuit board opposite the battery.

4. The security sensor of example 3 wherein the antenna is formed on a side of the circuit board opposite the wall.

5. The security sensor of example wherein the base connectors are configured to hold a battery.

6. The security sensor of any of examples 1-5 wherein the wall mount further comprises:
connectors to hold a battery; and
conductors coupled to the connectors to mate with the connectors of the cover.

7. The security sensor of any of examples 1-6 wherein the wall mount comprises multiple protrusions to guide the cover into a snap fit retentive connection with the wall mount.

8. The security sensor of any of examples 1-7 wherein the sensor comprises a magnetically actuated switch.

9. The security sensor of any of examples 1-8 wherein the sensor comprises a motion detector.

10. The security sensor of any of examples 1-9 wherein the sensor comprises a glass break sensor.

11. A method comprising:
installing a wall mount on a metal containing structure; and
coupling a cover to the wall mount, wherein the cover contains a circuit board receiving security sensor signals and transmitting information via an antenna coupled to the circuit board, the circuit board being positioned such that the antenna is spaced from the structure to reduce electromagnetic interference from the metal in the structure.

12. The method of example 11 wherein the cover further includes a battery coupled to the circuit board on a side opposite a side containing the antenna.

13. The method of any of examples 11-12 wherein coupling the cover to the wall mount comprises pressing the cover into a snap fit retentive position on the wall mount.

14. The method of any of examples 11-13 wherein installing the wall mount on the metal containing structure comprises using screws to fasten the wall mount to the metal containing structure.

15. The method of example 14 wherein the metal containing structure is a door.

16. The method of example 14 wherein the metal containing structure is a window frame.

17. A security sensor comprising:
a wall mount having features for fixing the wall mount to a wall to monitor an area for security;
a cover adapted to attach to the wall mount, the cover further comprising:
a base to couple to the wall mount;
connectors to couple to a power source;
a circuit board supported proximate the base and coupled to the connectors, the circuit board having a transmitter to receive signals from a sensor and wirelessly transmit the signals; and
an antenna formed on a side of the circuit board opposite the wall mount and spaced from the wall to reduce electromagnetic interference from the wall.

18. The security sensor of example 17 wherein the wall mount further comprises:
connectors to hold a battery; and
conductors coupled to the connectors to mate with the connectors of the cover.

19. The security sensor of any of examples 17-18 wherein the wall mount comprises multiple protrusions to guide the cover into a snap fit retentive connection with the wall mount.

20. The security sensor of any of examples 17-19 wherein the sensor comprises a magnetically actuated switch and wherein the antenna comprises a metamaterial and is positioned on a side of the circuit board opposite the power source.

Although a few embodiments have been described in detail above, other modifications are possible. For example, the logic flows depicted in the figures do not require the particular order shown, or sequential order, to achieve desirable results. Other steps may be provided, or steps may be eliminated, from the described flows, and other components may be added to, or removed from, the described systems. Other embodiments may be within the scope of the following claims.

The invention claimed is:

1. A security sensor comprising:

a wall mount having features for fixing the wall mount to a wall to monitor an area for security;

a cover adapted to attach to the wall mount, the cover further comprising:

a base to couple to the wall mount;

connectors to couple to a power source;

a circuit board supported proximate the base and coupled to the connectors, the circuit board having a transmitter to receive signals from a sensor and wirelessly transmit the signals; and an antenna coupled to the circuit board and spaced from the wall to reduce electromagnetic interference from the wall.

2. The security sensor of claim 1 wherein the base includes a side wall to distance the base from an outside of the wall and couple to the wall mount, and wherein the wall comprises a structure.

3. The security sensor of claim 1 wherein the power source comprises a battery and wherein the antenna is formed on a surface of the circuit board opposite the battery.

4. The security sensor of claim 3 wherein the antenna is formed on a surface of the circuit board opposite the wall.

5. The security sensor of claim 1 wherein the base connectors are configured to hold a battery.

6. The security sensor of claim 1 wherein the wall mount further comprises:

connectors to hold a battery; and conductors coupled to the connectors to mate with the connectors of the cover.

7. The security sensor of claim 1 wherein the wall mount comprises multiple protrusions to guide the cover into a snap fit retentive connection with the wall mount.

8. The security sensor of claim 1 wherein the sensor comprises a magnetically actuated switch.

9. The security sensor of claim 1 wherein the sensor comprises a motion detector.

10. The security sensor of claim 1 wherein the sensor comprises a glass break sensor.

11. A method comprising:

installing a wall mount on a metal containing structure; and coupling a cover to the wall mount, wherein the cover contains a circuit board receiving security sensor signals and transmitting information via an antenna coupled to the circuit board, the circuit board being positioned such that the antenna is spaced from the structure to reduce electromagnetic interference from the metal in the structure.

12. The method of claim 11 wherein the cover further includes a battery coupled to the circuit board on a side opposite a side containing the antenna.

13. The method of claim 11 wherein coupling the cover to the wall mount comprises pressing the cover into a snap fit retentive position on the wall mount.

14. The method of claim 11 wherein installing the wall mount on the metal containing structure comprises using screws to fasten the wall mount to the metal containing structure.

15. The method of claim 14 wherein the metal containing structure is a door.

16. The method of claim 14 wherein the metal containing structure is a window frame.

17. A security sensor comprising:

a wall mount having features for fixing the wall mount to a wall to monitor an area for security;

a cover adapted to attach to the wall mount, the cover further comprising:

a base to couple to the wall mount;

connectors to couple to a power source;

a circuit board supported proximate the base and coupled to the connectors, the circuit board having a transmitter to receive signals from a sensor and wirelessly transmit the signals; and an antenna formed on a side of the circuit board opposite the wall mount and spaced from the wall to reduce electromagnetic interference from the wall.

18. The security sensor of claim 17 wherein the wall mount further comprises:

connectors to hold a battery; and conductors coupled to the connectors to mate with the connectors of the cover.

19. The security sensor of claim 17 wherein the wall mount comprises multiple protrusions to guide the cover into a snap fit retentive connection with the wall mount.

20. The security sensor of claim 17 wherein the sensor comprises a magnetically actuated switch and wherein the antenna comprises a metamaterial and is positioned on a surface of the circuit board opposite the power source.

* * * * *